US008292586B2

(12) United States Patent
Bottome

(10) Patent No.: US 8,292,586 B2
(45) Date of Patent: Oct. 23, 2012

(54) ANNULUS FILLER

(75) Inventor: Kristofer John Bottome, Nottingham (GB)

(73) Assignee: Rolls-Royce PLC, London (GB)

( * ) Notice: Subject to any disclaimer, the term of this patent is extended or adjusted under 35 U.S.C. 154(b) by 863 days.

(21) Appl. No.: 12/320,176

(22) Filed: Jan. 21, 2009

(65) Prior Publication Data

US 2009/0208335 A1 Aug. 20, 2009

(30) Foreign Application Priority Data

Feb. 18, 2008 (GB) ..... 0802834.2

(51) Int. Cl.
*F01D 5/22* (2006.01)

(52) U.S. Cl. ..... 416/191; 416/193 A

(58) Field of Classification Search ..... 416/191, 416/193 A, 204 A, 214 A, 244 A, 248
See application file for complete search history.

(56) References Cited

U.S. PATENT DOCUMENTS

| | | | | |
|---|---|---|---|---|
| 5,277,548 | A | 1/1994 | Klein et al. | |
| 5,466,125 | A | 11/1995 | Knott | |
| 5,599,170 | A * | 2/1997 | Marchi et al. | 416/190 |
| 6,726,452 | B2 * | 4/2004 | Strassberger et al. | 416/190 |
| 6,832,896 | B1 * | 12/2004 | Goga et al. | 416/191 |
| 7,153,099 | B2 * | 12/2006 | Queriault et al. | 416/2 |
| 7,284,958 | B2 * | 10/2007 | Dundas et al. | 416/193 A |
| 8,066,479 | B2 * | 11/2011 | El-Aini et al. | 416/1 |
| 2010/0040472 | A1 * | 2/2010 | Read et al. | 416/204 R |

FOREIGN PATENT DOCUMENTS

| | | |
|---|---|---|
| GB | 1093568 | 12/1967 |
| GB | 2 006 883 A | 5/1979 |
| WO | WO 93/21425 A1 | 10/1993 |

* cited by examiner

*Primary Examiner* — Dean O Takaoka
*Assistant Examiner* — Alan Wong
(74) *Attorney, Agent, or Firm* — Oliff & Berridge, PLC

(57) ABSTRACT

An annulus filler is provided for mounting to a rotor disc of a gas turbine engine and for bridging the gap between two adjacent blades attached to the rotor disc. The annulus filler has a body portion which defines an airflow surface for air being drawn through the engine, and one or more hook portions which extend radially inwardly from the body portion. The hook portions are for connection to corresponding engagement portions on the radially outer face of the rotor disc. The or each hook portion is attached to the body portion by a joining arrangement in which a wedge part provided by one of the hook portion and the body portion is received in a complementary-shaped retention recess provided by the other of the hook portion and the body portion.

11 Claims, 2 Drawing Sheets

ANNULUS FILLER

BACKGROUND

The present invention relates to annulus fillers for bridging gaps between adjacent blades of a gas turbine engine stage.

Conventionally, a compressor rotor stage in a gas turbine engine comprises a plurality of radially extending blades mounted on a disc. The blades are mounted on the disc by inserting a root portion of the blade in a complementary retention groove in the outer face of the disc periphery. To ensure a smooth radially inner surface for air to flow over as it passes through the stage, annulus fillers can be used to bridge the spaces between adjacent blades. Typically, a seal between the annulus fillers and the adjacent fan blades is also provided by resilient strips bonded to the annulus fillers adjacent the fan blades.

Annulus fillers of this type are commonly used in the fan stage of gas turbine engines. The fillers may be manufactured from relatively lightweight materials and, in the event of damage, may be replaced independently of the blades.

SUMMARY

It is known to provide annulus fillers with features for removably attaching them to the rotor disc. An annulus filler may be provided with axially spaced hook members, the hook members sliding into engagement with respective parts of the rotor disc and/or a component located axially behind the rotor assembly, for example a rear fan air seal. FIG. 1 shows an example of such an annulus filler viewed from the rear.

In use, the upper surface or lid 14 of the annulus filler 12 bridges the gap between two adjacent fan blades (not shown) and defines the inner wall of the flow annulus of a fan stage. The annulus filler 12 is mounted on a fan disc (not shown) by two hook members 16 and 18, respectively towards the forward and rearward ends of the annulus filler 12. It is also attached to a support ring (not shown) by a mounting feature 20. The two opposed side faces 22, 24 of the annulus filler are provided with respective seal strips 26, 28, and confront the aerofoil surfaces of the adjacent fan blades. Typically the annulus filler is a machined aluminium alloy forging.

Further known annulus filler are described in WO 93/21425. Annulus fillers of this type are self-loading in that, as a rotating component, the majority of forces on the filler are generated by its own mass. A lighter filler would therefore reduce its own internal forces as well as reducing forces on the rotor disc. More generally, reducing the mass of the engine contributes to improved airframe efficiency.

Thus, in general terms, the present invention provides an annulus filler in which one or more hook portions for connecting to a rotor disc are attached to a body portion which defines an airflow surface for air being drawn through the engine in such a way that different materials can be used for the body portion and hook portion(s). In this way, the materials for the body portion and hook portion(s) can be chosen to provide optimise strength and weight-saving.

In a first aspect, the present invention provides an annulus filler for mounting to a rotor disc of a gas turbine engine and for bridging the gap between two adjacent blades attached to the rotor disc, the annulus filler having:

a body portion which defines an airflow surface for air being drawn through the engine, and one or more hook portions which extend radially inwardly from the body portion for connection to corresponding engagement portions on the radially outer face of the rotor disc;

wherein the or each hook portion is attached to the body portion by a joining arrangement in which a wedge part provided by one of the hook portion and the body portion is received in a complementary-shaped retention recess provided by the other of the hook portion and the body portion.

Preferably, the hook portion provides the wedge part and the body portion provides the retention recess. Conveniently, either or both of the wedge part and the retention recess can be formed by facing angled flanges.

Advantageously, the joining arrangement can help to ensure that the filler body and hook portion do not come apart under centrifugal loading.

Preferably, the body portion is formed from a plastics material, such as a fibre reinforced composite.

Preferably, the or each hook portion is formed from a metal material, such as a titanium alloy.

Thus, relative to a conventional aluminium one-piece annulus filler, the filler body can be made more light-weight, while retaining adequate strength, stiffness and toughness. Similarly, the hook portion can be strengthened, or made lighter for a given strength.

Although parts of the annulus filler may formed of different materials, the overall configuration of the filler of the present invention can be such as to allow it to be used in the same engine as a conventional one-piece filler. Thus redesign of the rotor disc can be avoided, and the filler can be retrofitted to existing engines.

Supplementary arrangements can be used to join the or each hook portion to the body portion. For example, the or each hook portion may be adhesively bonded to the body portion. The or each hook portion may be fixed to the body portion by one or more mechanical fixture devices, such as rivets or bolts.

Preferably, the annulus filler has two axially-spaced hook portions.

Preferably, the blades are fan blades.

The or each hook portion may be attached to the body portion in such a way that an old or damaged body portion or hook portion may be replaced by a new such portion. That is, the portions may be separately repairable or replaceable. Thus further aspects of the invention provide a body portion for the annulus filler according to the first aspect, and a hook portion for the annulus filler according to the first aspect.

Another aspect of the invention provides a stage for a gas turbine engine having:

a rotor disc, a plurality of circumferentially spaced apart blades attached to the rotor disc, and a plurality of annulus fillers according to the first aspect bridging the gaps between adjacent blades.

BRIEF DESCRIPTION OF THE DRAWINGS

Embodiments of the invention will now be described by way of example with reference to the accompanying drawings in which.

DETAILED DESCRIPTION

Figure 2:
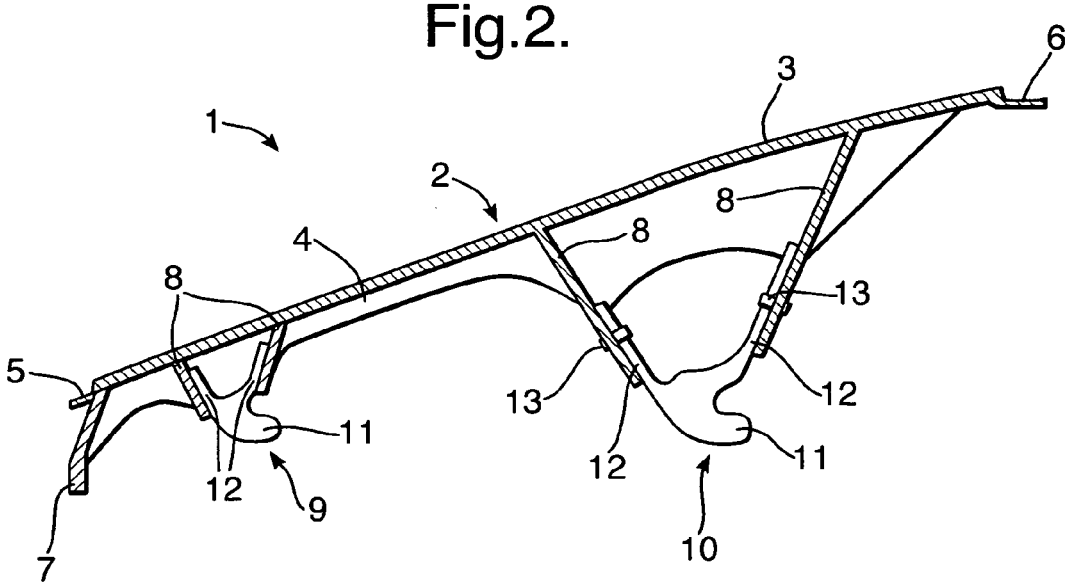
FIG. 2 shows an example of an annulus filler of the present invention viewed from the side.

In FIG. 2, a side view of an example of an annulus filler 1 for a fan rotor is shown. The filler 1 has a body portion 2 comprising: a lid part 3 that defines an airflow surface for air being drawn through the engine; a strengthening/stiffening rib 4 that extends from front to rear of the filler along its centre line; forward and rearward lips 5, 6 which, in use, respectively site under a spinner make-up piece or fairing and a fan rear seal; a front piece 7 which may carry a fit pin or other locating device; and front and rear retention recesses, each formed by a pair of facing angled flanges 8 extending side-to-side across the width of the body portion.

The filler also has front and rear hook portions 9, 10. Each hook portion has a rearward facing hook 11 which, in use, engages with a corresponding forward facing hook on the outer radial wall of the rotor disc. Each hook portion has a wedge part formed by a pair of facing angled flanges 12. The wedge part of the front hook portion is complementary to and fits in the front retention recess of the body portion, and the wedge part of the rear hook portion is complementary to and fits in the rear retention recess of the body portion. Thus-fitted, each wedge part flange rests against a corresponding retention recess flange.

The shape of the wedge parts and the retention recesses prevents the body portion and hook portions from coming apart under centrifugal loading. However, the interfaces between contacting flanges of the wedge parts and retention recesses can also be adhesively bonded to prevent the hook portions detaching from the body portion under other types of loading that the filler may encounter. Under normal running conditions, the adhesive bond experiences a mixture of shear and compressive forces.

To further secure the hook portions to the body portion, and particularly to supply resistance to peel forces, rivets 13 or other mechanical fixing devices may be inserted across the contacting flanges.

Figure 3A:
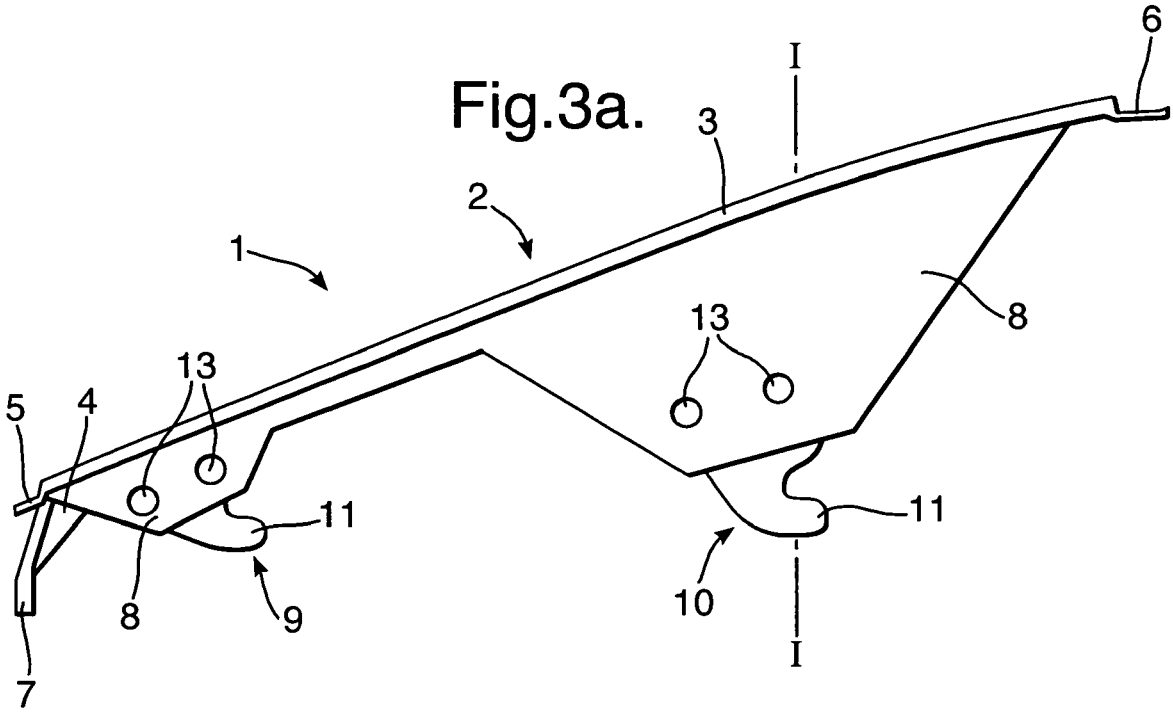
FIGS. 3*a* and 3*b* show another example of an annulus filler of the present invention viewed respectively from the side and on a cross section along plane I-I.

FIGS. 3*a* and *b* show another example of an annulus filler of the present invention viewed respectively from the side and on a cross section along plane I-I.

Figure 3B:
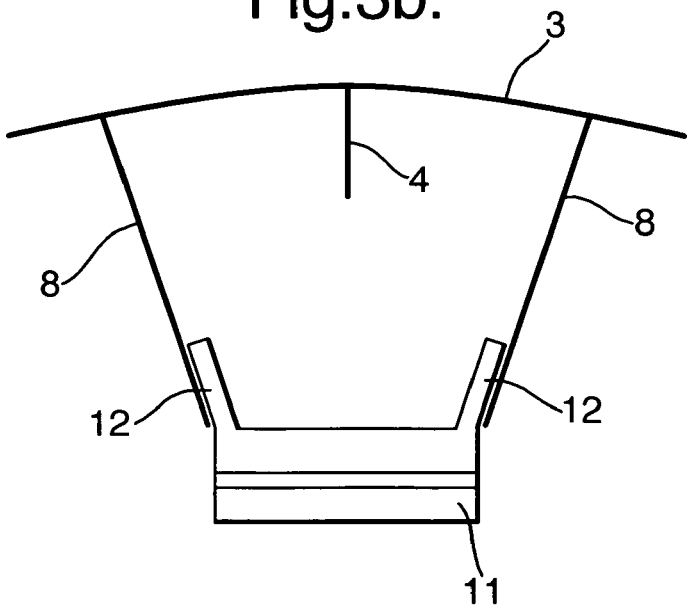

The filler of FIG. 3 is similar to the filler of FIG. 2 and the same reference numbers are used to indicate equivalent features. However, a difference relative to the filler of FIG. 2 is that the front and rear retention recesses, each still formed by a pair of facing angled flanges 8, now run fore and aft rather than side-to-side. Likewise, the wedge parts of the hook portions 9, 10 are still formed by pairs of facing angled flanges 12, but these also run fore and aft in correspondence with the flanges 8.

In FIG. 3 the front and rear retention recesses are shown as discrete features. However, a possible modification would be to form a single retention recess running the length of the filler. Likewise, the wedge parts of the hook portions could be joined to form a single wedge part.

In the fillers of both examples, the material for the body portion may be a carbon or glass fibre reinforced thermoplastic, such as Torlon™ 5030/7030 (polyamide-imide) from Solvay Advanced Polymers. Such a part can be formed by injection or compression moulding. An alternative is to form the body portion from fibre reinforced epoxy e.g. by compression moulding. Injection moulding generally requires short reinforcing fibres. Compression moulding could use longer fibres.

The hook portions may be formed from titanium 6-4 alloy. This can be extruded or metal injection moulded to near net shape.

Figure 1:
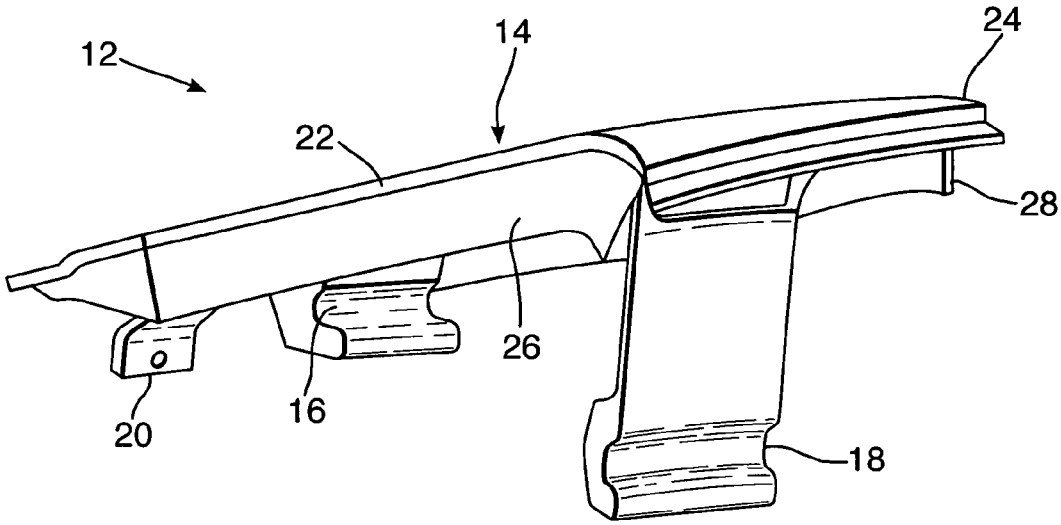
Fig.1. (Prior Art)
FIG. 1 shows an example of conventional annulus filler viewed from the rear.

Relative to the conventional aluminium annulus filler of FIG. 1, the filler according to the examples can have improved fatigue resistance. Specifically, in the conventional filler, the areas of highest stress are the insides of the hooks and the points of attachment of the hook members 16, 18 to the lid 14. However, in the examples, when the hook portions 9, 10 are formed from titanium 6-4 alloy, a higher stress at a $10^5$ fatigue cycle can be permitted. Further, by using a plastics composite body portion 2, the overall mass of the filler can be reduced, which decreases the load on the hook portions.

Thus the lightweight, two-material annulus fillers of FIGS. 2 and 3 can provide significant performance advances over the conventional filler.

Although not shown, seal strips can be adhesively bonded to the lateral edges of the lid part 3. Alternatively, seal strips can be co-cured or co-moulded to the lid part as part of the manufacturing process.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

I claim:

1. An annulus filler for mounting to a rotor disc of a gas turbine engine and for bridging the gap between two adjacent blades attached to the rotor disc, the annulus filler having:

a body portion which defines an airflow surface for air being drawn through the engine, and one or more hook portions which extend radially inwardly from the body portion for connection to corresponding engagement portions on the radially outer face of the rotor disc;

wherein the one or more hook portions are attached to the body portion by a joining arrangement in which a wedge part formed by a pair of facing angled flanges is provided by one of the one or more hook portions and the body portion and is received in complementary-shaped retention recess flanges provided by another of the one or more hook portions and the body portion.

2. An annulus filler according to claim 1, wherein the one or more hook portions provide the wedge part and the body portion provides the retention recess flanges.

3. An annulus filler according to claim 1, wherein the body portion is formed from a first material, and the one or more hook portions are formed from a different second material.

4. An annulus filler according to claim 1, wherein the body portion is formed from a plastics material.

5. An annulus filler according to claim 1, wherein the one or more hook portions are formed from a metal material.

6. An annulus filler according to claim 1, wherein the one or more hook portions are adhesively bonded to the body portion.

7. An annulus filler according to claim 1, wherein the one or more hook portions are fixed to the body portion by one or more mechanical fixture devices.

8. An annulus filler according to claim 1, having two axially-spaced hook portions.

9. An annulus filler according to claim 1, wherein the blades are fan blades.

10. An annulus filler according to claim 1, wherein the body portion is provided with a stiffening rib.

11. An annulus filler according to claim 1, wherein the body portion is provided with a stiffening rib that extends along the center of the body portion.

* * * * *